US012110594B2

(12) United States Patent
Shin et al.

(10) Patent No.: US 12,110,594 B2
(45) Date of Patent: Oct. 8, 2024

(54) COMPOSITION FOR ELECTROLESS PLATINUM PLATING AND ELECTROLESS PLATINUM PLATING METHOD USING THE SAME

(71) Applicant: FOUNDATION OF SOONGSIL UNIVERSITY-INDUSTRY COOPERATION, Seoul (KR)

(72) Inventors: Kuan Soo Shin, Seoul (KR); Jeong Hei Choi, Uijeongbu-si (KR); Yoon Kyung Jung, Daejeon (KR); Min Young Cho, Seoul (KR)

(73) Assignee: FOUNDATION OF SOONGSIL UNIVERSITY-INDUSTRY COOPERATION, Seoul (KR)

( * ) Notice: Subject to any disclaimer, the term of this patent is extended or adjusted under 35 U.S.C. 154(b) by 6 days.

(21) Appl. No.: 17/476,508

(22) Filed: Sep. 16, 2021

(65) Prior Publication Data

US 2022/0112604 A1 Apr. 14, 2022

(30) Foreign Application Priority Data

Oct. 13, 2020 (KR) ..... 10-2020-0131880
Jul. 23, 2021 (KR) ..... 10-2021-0096969

(51) Int. Cl.
*C23C 18/44* (2006.01)
*C23C 18/16* (2006.01)

(52) U.S. Cl.
CPC ..... *C23C 18/44* (2013.01); *C23C 18/1641* (2013.01)

(58) Field of Classification Search
CPC ..... C23C 18/42; C23C 18/44; C23C 18/48; C23C 18/54; C23C 18/1635; C23C 18/1639; C23C 18/1641; C23C 18/1644; C23C 18/1676
See application file for complete search history.

(56) References Cited

U.S. PATENT DOCUMENTS 5,925,415 A * 7/1999 Fry ..... C23C 18/1658 427/443.1
2004/0063915 A1* 4/2004 Diner ..... C23C 18/1893 530/391.1
2015/0056379 A1* 2/2015 Shin ..... C23C 18/44 427/443.1
2017/0260400 A1* 9/2017 Morimoto ..... C09D 4/06
2019/0309423 A1* 10/2019 Sasamura ..... C23C 18/1662
2020/0157686 A1* 5/2020 Shibata ..... C23C 18/168

FOREIGN PATENT DOCUMENTS

KR 10-1445461 B1 9/2014
KR 2018-224987 A 12/2018
KR 20190119023 * 10/2019
KR 10-2020-0008113 A 1/2020

* cited by examiner

*Primary Examiner* — Dah-Wei D. Yuan
*Assistant Examiner* — Nga Leung V Law
(74) *Attorney, Agent, or Firm* — Revolution IP, PLLC

(57) ABSTRACT

The present invention relates to a composition for electroless platinum plating and an electroless platinum plating method using the same, wherein it is possible to easily and safely produce a uniformly dispersed platinum thin film without expensive additional equipment by performing electroless platinum plating with a composition for electroless platinum plating containing an alcohol, an aqueous solution of a platinum chloride compound, and an aqueous solution of a basic compound.

4 Claims, 11 Drawing Sheets

20

[FIG. 1A]
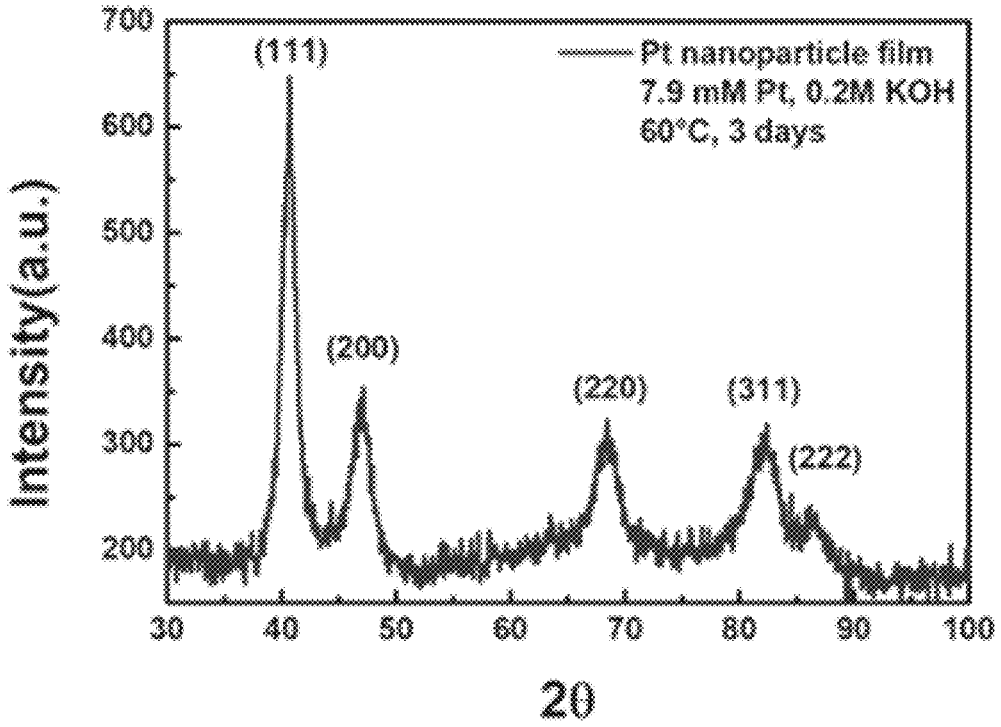

[FIG. 1B]
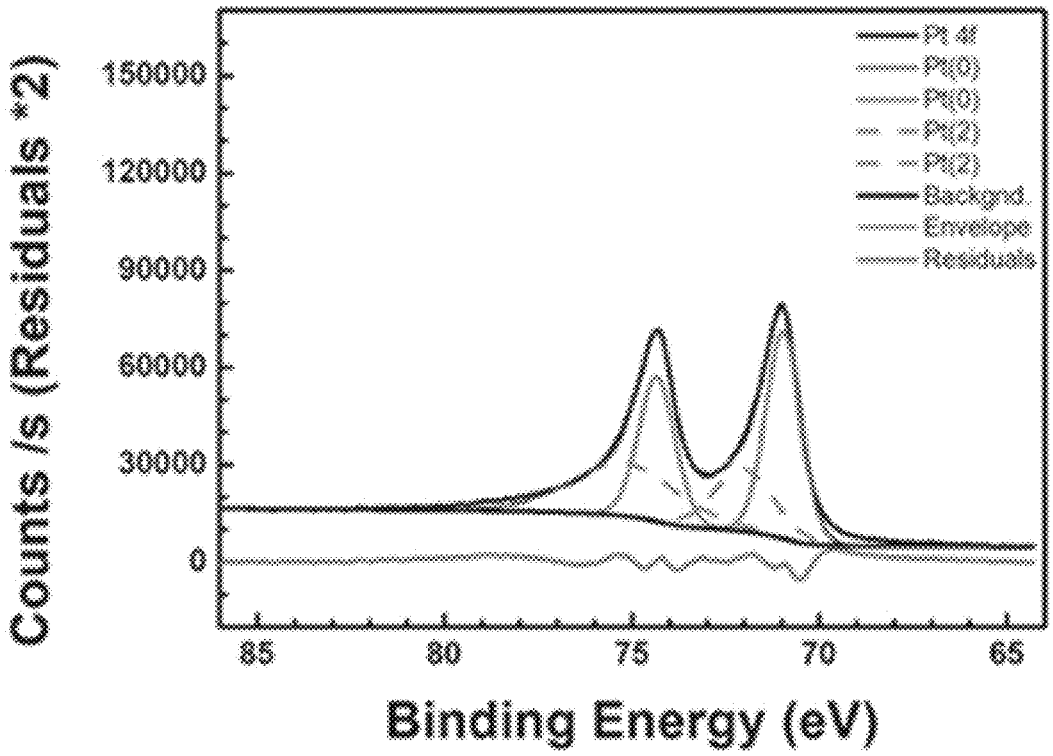

[FIG. 2A]
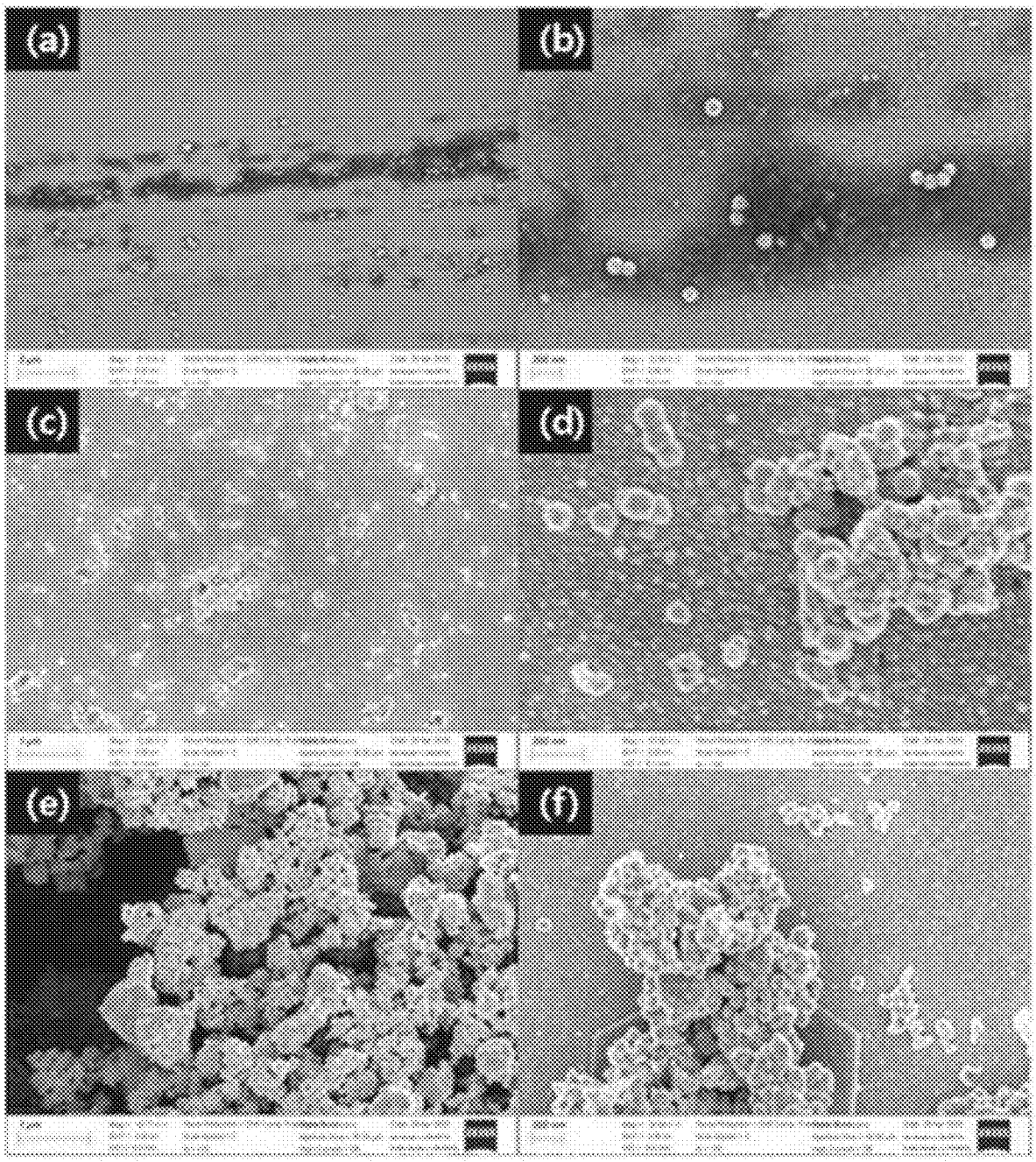

[FIG. 2B]
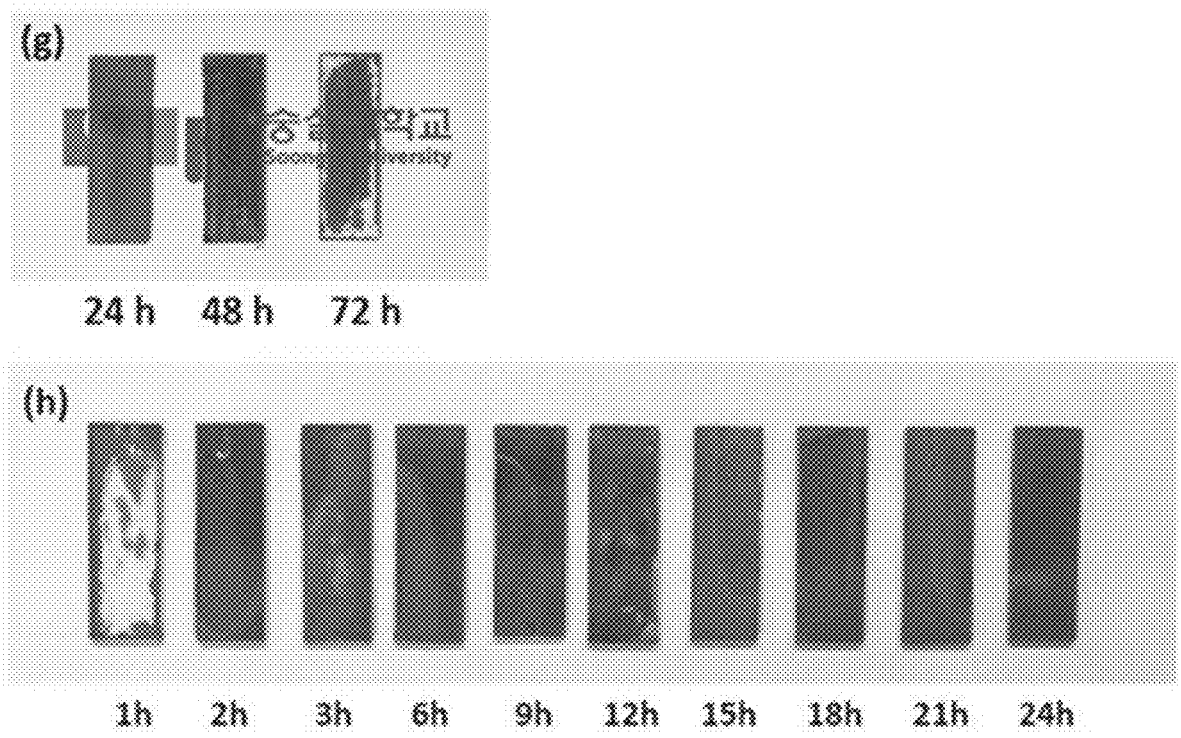

[FIG. 3]
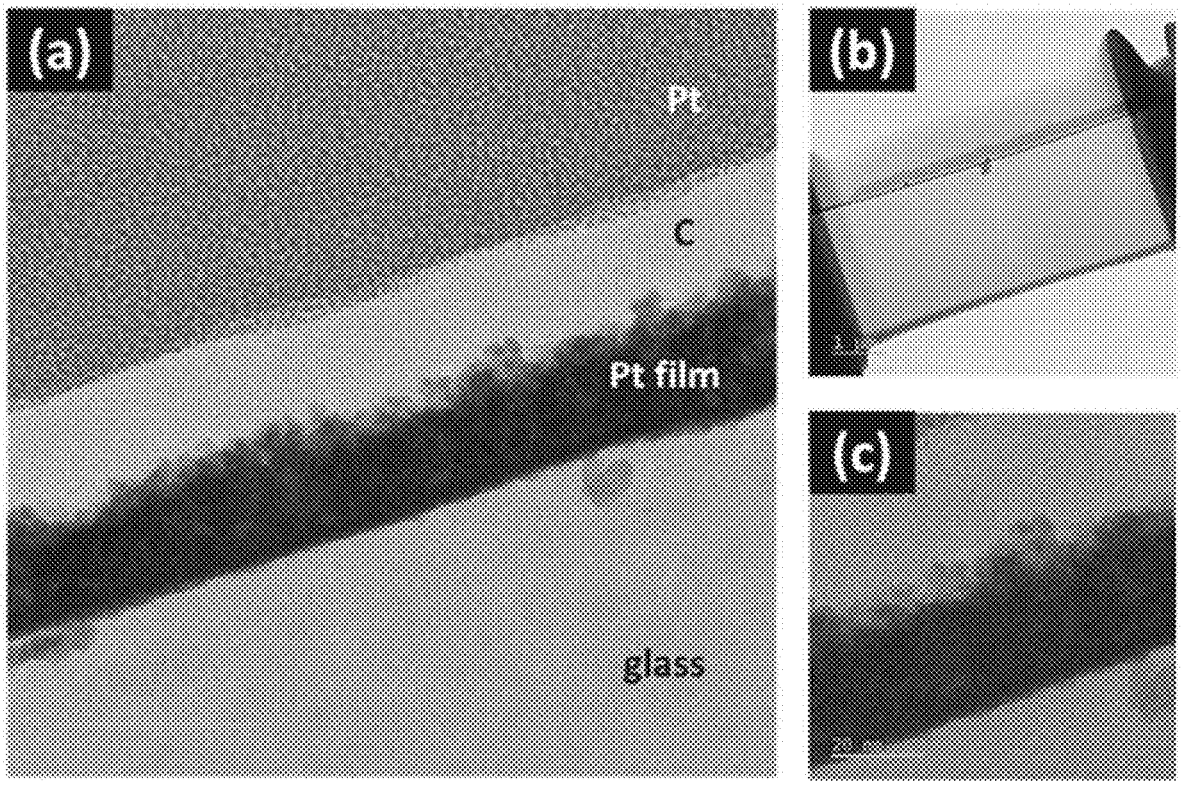

[FIG. 4]
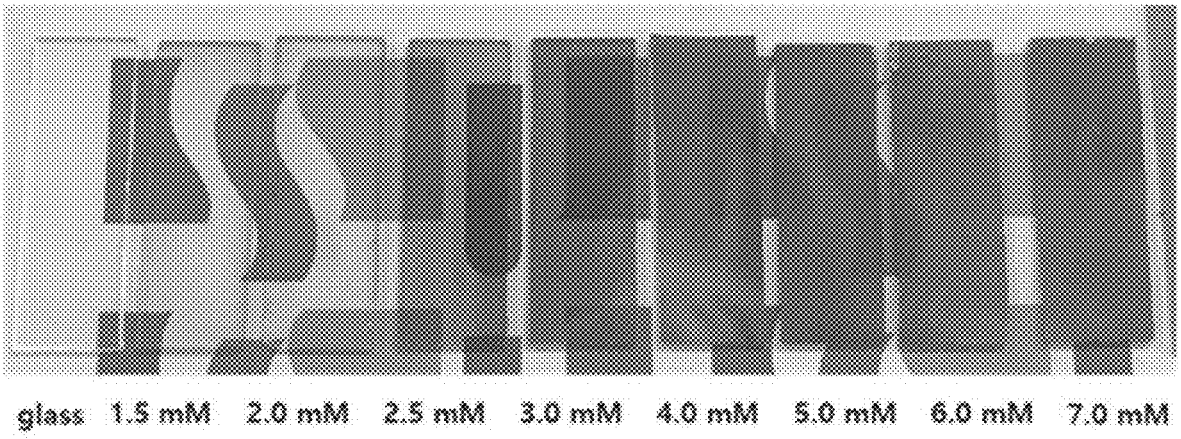
[FIG. 5A]
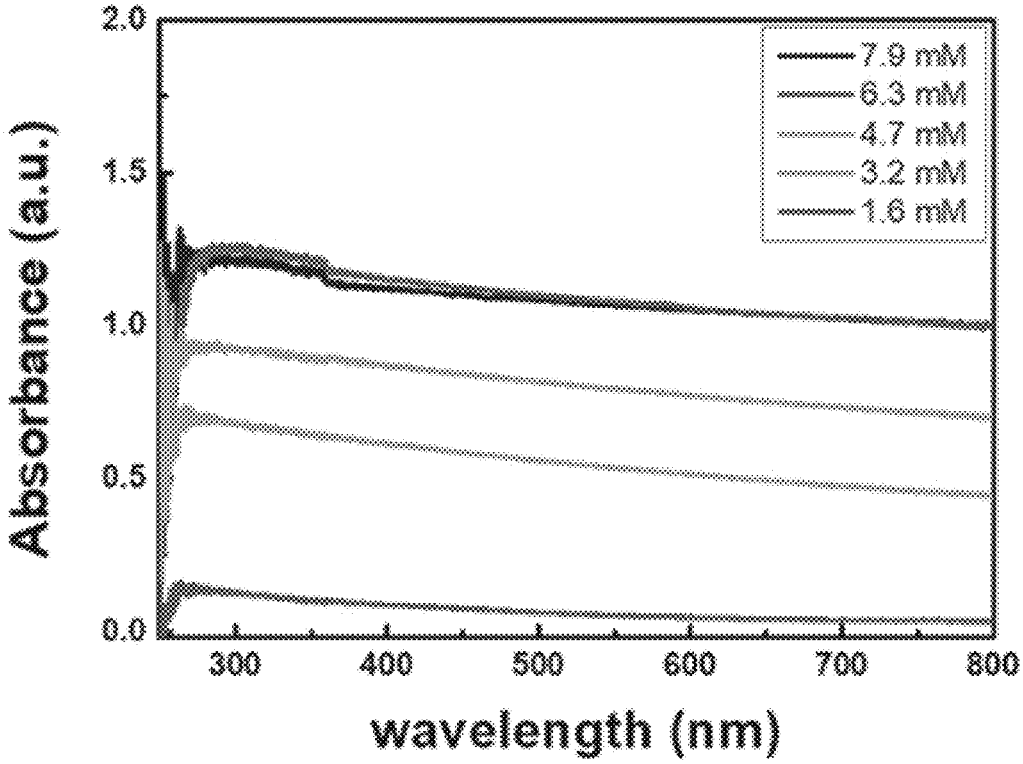

[FIG. 5B]
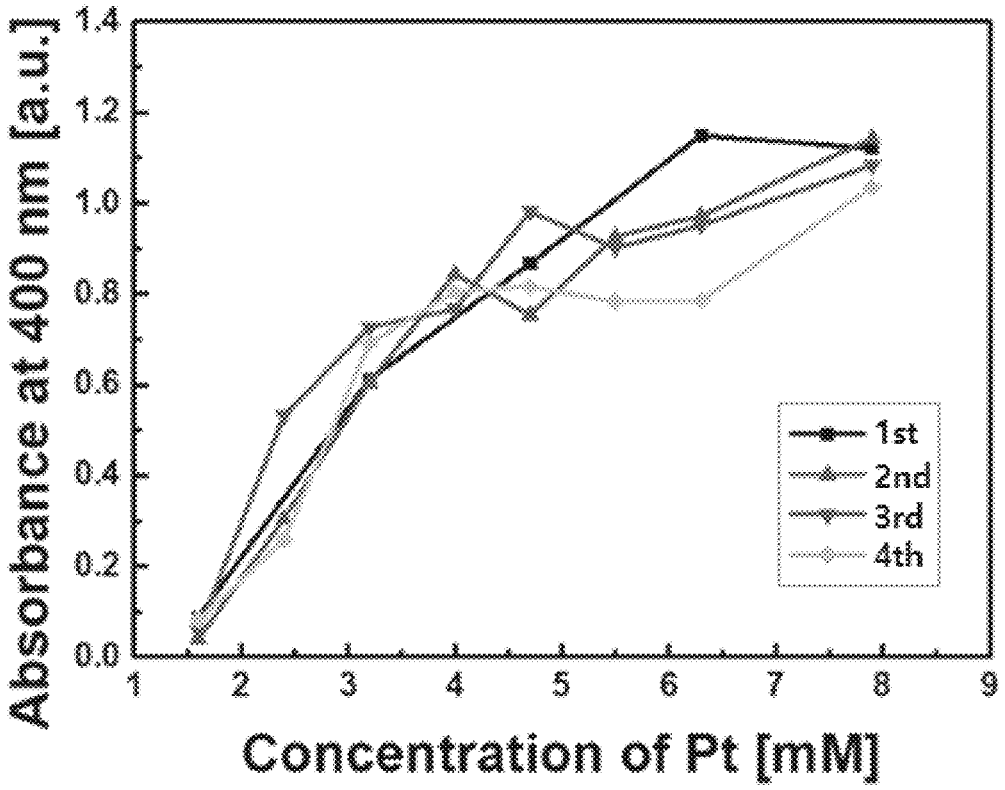

[FIG. 6]
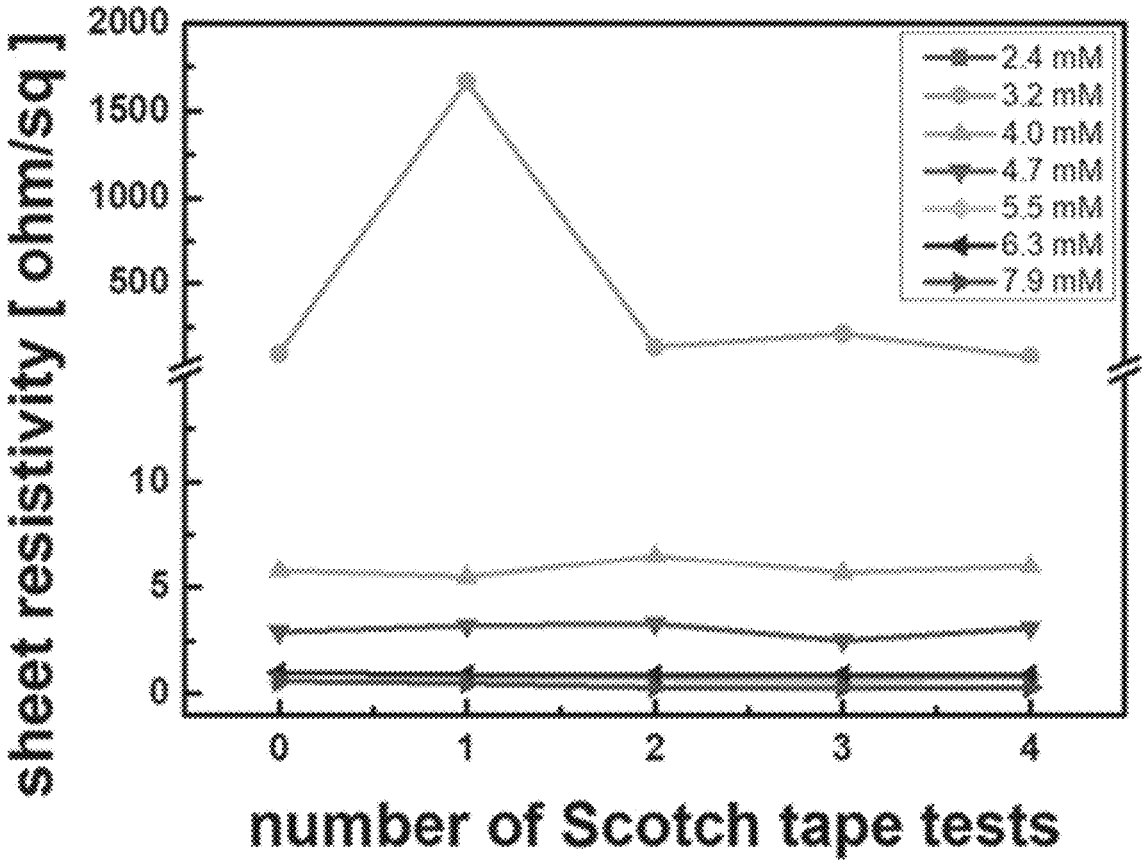

[FIG. 7]
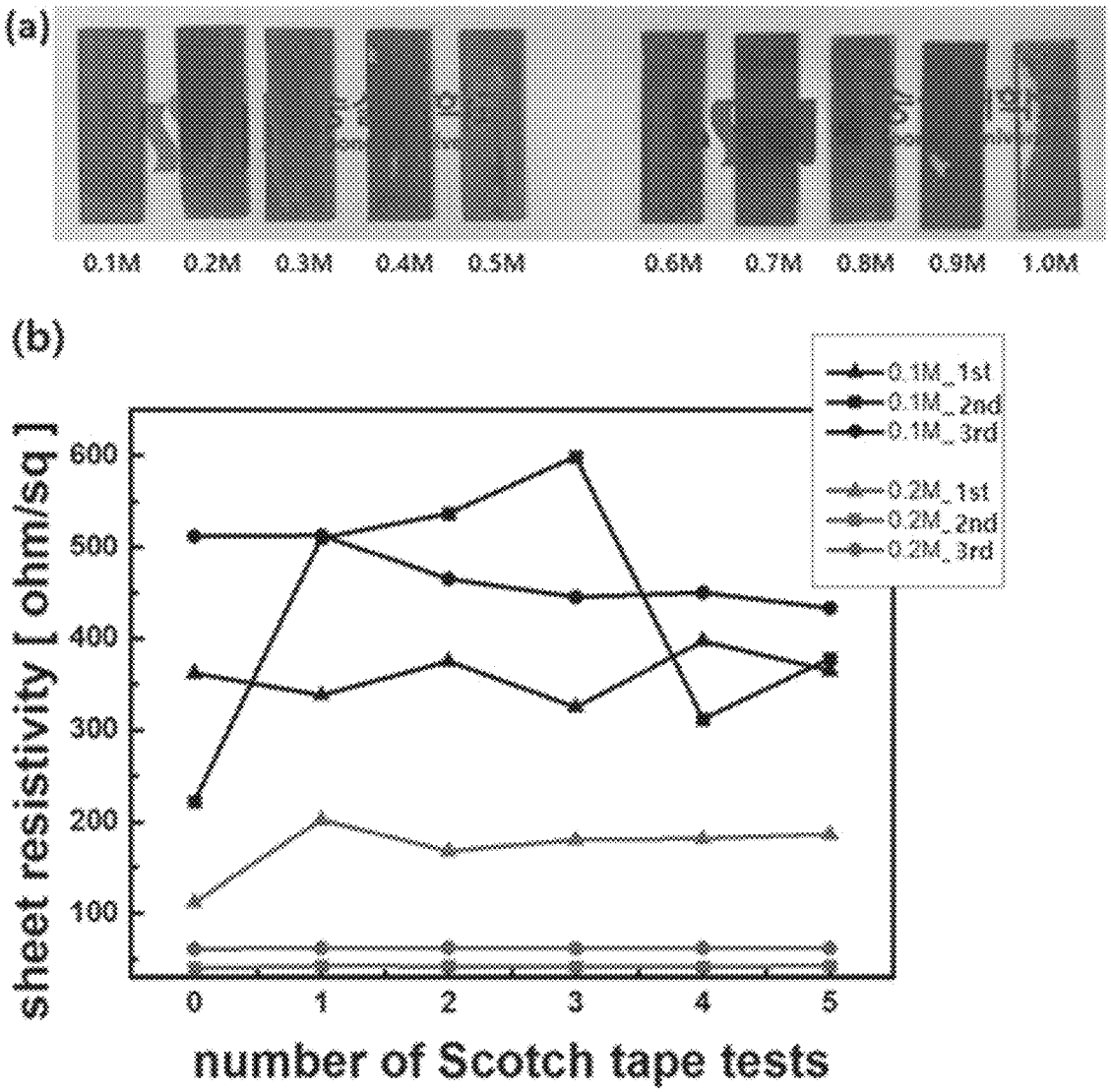

[FIG. 8]
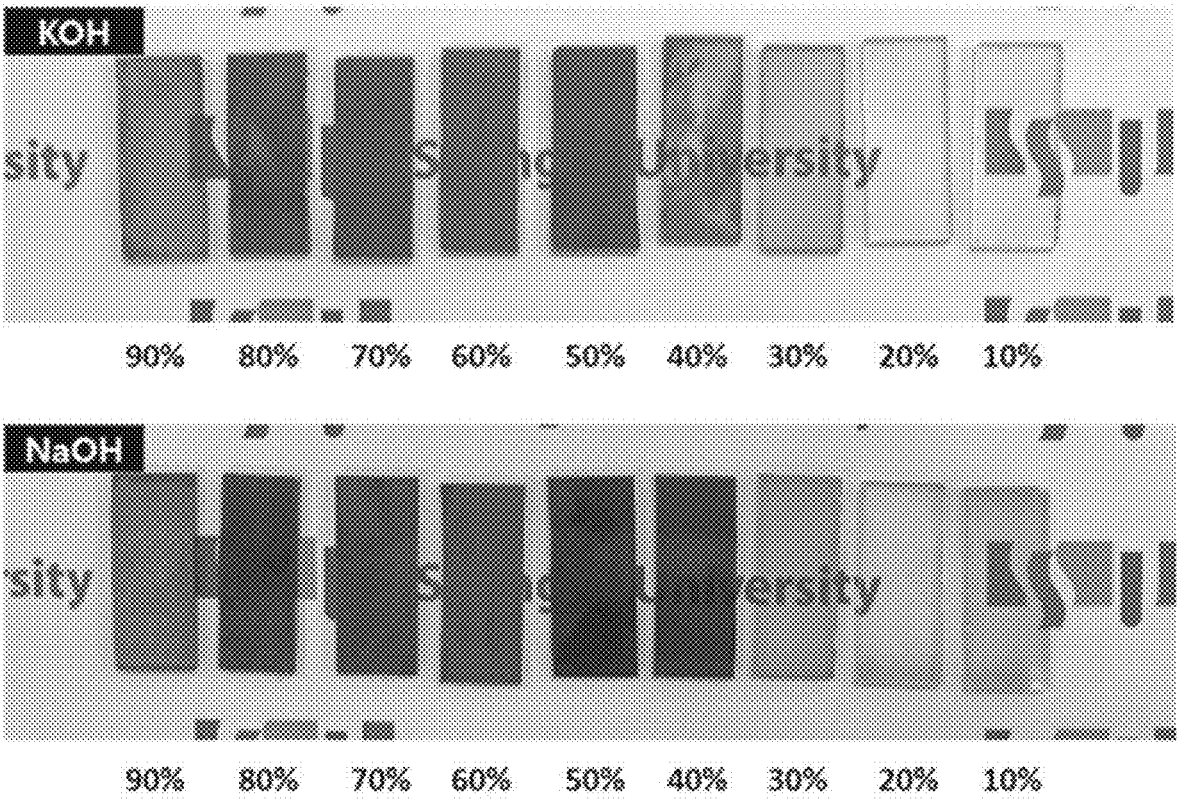

[FIG. 9]
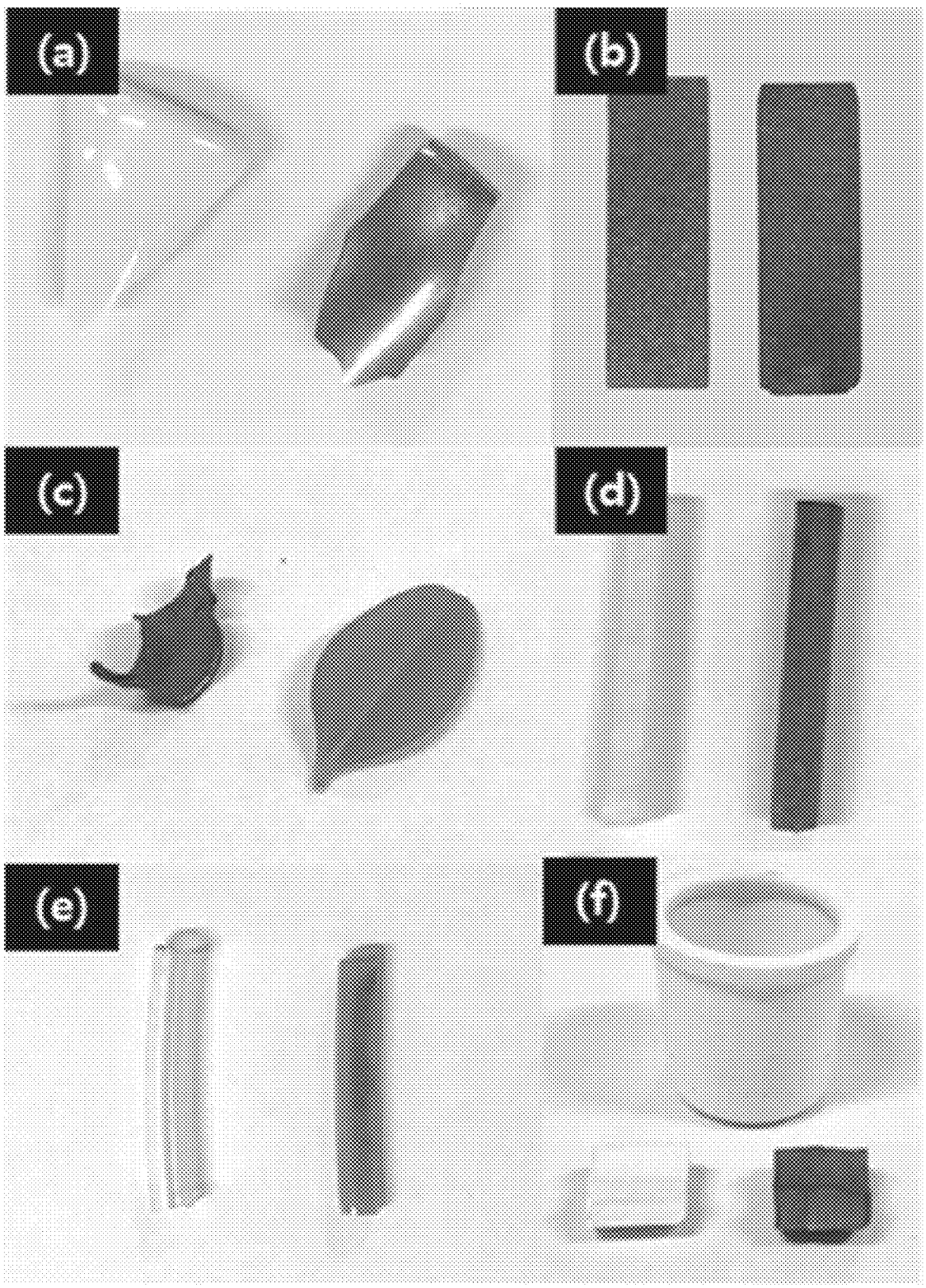

COMPOSITION FOR ELECTROLESS PLATINUM PLATING AND ELECTROLESS PLATINUM PLATING METHOD USING THE SAME

BACKGROUND OF THE INVENTION

1. Field of the Invention

The present invention relates to a composition for electroless platinum plating and a method for electroless platinum plating using the same.

2. Description of the Related Art

In general, a platinum (Pt) thin film is usually produced using three methods. These methods include an electro-deposition method, a vapor deposition method, and an electroless plating method.

The electro-deposition method has several inherent disadvantages. Accurate voltage or current is required in the deposition environment, and sophisticated, expensive equipment is required to ensure deposition. Further, electrical contact should be made with a surface to be plated, and there is a limit that the surface should be conductive for this purpose. In addition, a very complicated circuit pattern is required, or for a high-density integrated circuit, it takes a lot of time for electrical deposition and it is difficult to achieve the purpose.

Further, the vapor deposition method also has several disadvantages. For this deposition method, sophisticated high-vacuum equipment is required, which incurs additional costs for the equipment, and operation of the equipment or a deposition process may be dangerous. In addition, a lot of platinum (Pt) metal is consumed in an evaporation process, and it is difficult to select an area to be deposited in the process of re-depositing the evaporated platinum. In other words, there is a problem that pattern design with platinum cannot be easily performed using the vapor deposition process.

The electroless plating method is a method of depositing a metal on a surface of an object to be plated, and has several advantages compared to the other deposition methods. Since the electroless plating method does not receive electric energy from the outside, deposition is possible even in the case that an object to be plated is a non-conductive substrate. In addition, since high vacuum is not required, expensive additional equipment is not required. However, the conventional electroless plating method has an environmental problem of inducing contamination of the human body and the natural environment in the case that a highly toxic cyanide compound is used or a process of synthesizing a platinum precursor is required.

Accordingly, there is a need to research a composition for electroless plating and an electroless platinum plating method using it capable of forming a stably and uniformly dispersed platinum thin film in a simple and safe manner without using expensive equipment or precious metals as well as requiring additional procedures.

Prior Art Document: Korean Patent No. 10-1445461 (published on Nov. 1, 2012)

SUMMARY OF THE INVENTION

Problem to be Solved by the Invention

An object of the present invention is to provide a composition for electroless plating capable of forming a stable and uniform platinum thin film in a simple and safe manner without requiring additional equipment or complicated procedures, and an electroless platinum plating method using it.

Another object of the present invention is to provide an article coated with a platinum thin film prepared by the electroless platinum plating method.

Means for Solving the Problem

In order to achieve the above object, the present invention provides a composition for electroless platinum plating containing an alcohol, an aqueous solution of a platinum chloride compound, and an aqueous solution of a basic compound.

Further, the present invention provides an electroless platinum plating method including the step of dipping a substrate in the composition for electroless platinum plating and shaking it to form a platinum thin film.

Furthermore, the present invention provides an article coated with the platinum thin film prepared by the electroless platinum plating method.

The electroless platinum plating method using the composition for electroless platinum plating according to the present invention is safe by using weakly toxic compounds as raw materials and can form a platinum thin film uniformly dispersed without the expensive additional equipment conventionally required simply and stably.

In particular, there is an advantage that platinum plating is possible even on dielectric substrates that do not conduct electricity, such as glass, rubber, ceramics, paper, and natural materials. In addition, it can be used for various electrochemical products because the size of platinum particles and thin film thickness can be adjusted according to reaction time, a platinum salt concentration of the composition, and the like.

BRIEF DESCRIPTION OF THE DRAWINGS

FIG. 1A shows an XRD graph and FIG. 1B shows an XPS graph of a platinum thin film obtained by electroless plating with a reaction composition according to an embodiment of the present invention. The background of FIG. 1B is a baseline, and the residual is a line limiting fitting in the envelope.

FIGS. 2A and 2B show SEM images for 24 hours (a, b), 48 hours (c, d), and 72 hours (e, f) of electroless-plated platinum (Pt) thin films according to dipping time in the reaction composition, an image of platinum plating on glass substrates under 24 hours, 48 hours, and 72 hours conditions (g), and an image of platinum plating on glass substrates under 1, 2, 3, 6, 9, 12, 15, 18, 21, and 24 hours conditions (h).

FIG. 3 shows FE-TEM images of a platinum (Pt) thin film after forming it for 24 hours.

FIG. 4 shows an image of platinum plating on glass substrates obtained by reacting for 24 hours with various concentrations of platinum salts.

FIG. 5A shows a UV-vis absorption analysis result of platinum (Pt) thin films prepared with various concentrations of platinum salts on glass substrates, and FIG. 5B shows a UV-vis absorption analysis result at 400 nm of a platinum thin film for each concentration.

FIG. 6 shows results of changes in sheet resistance using Scotch tape as a stability test of platinum (Pt) salt thin films of various concentrations.

FIG. 7 shows (a) an image of platinum plating on glass substrates by reaction with potassium hydroxide of various concentrations for 24 hours, and (b) results of changes in sheet resistance using Scotch tape as a stability test of potassium hydroxide thin films of various concentrations.

FIG. 8 shows an image of platinum plating on glass substrates by reaction with various parts by weight of alcohol for 18 hours.

FIG. 9 shows an image of platinum plating on various dielectric substrates with a composition for platinum plating according to the present invention.

DETAILED DESCRIPTION OF THE PREFERRED EMBODIMENT

Hereinafter, the present invention will be described in detail.

The present inventors have completed the present invention by finding that it was possible to form a uniformly dispersed platinum thin film simply and stably without expensive additional equipment in the case that electroless platinum plating is performed with a composition for electroless platinum plating including an alcohol, a chloroplatinic acid hexahydrate ($H_2PtCl_6$) aqueous solution, and a potassium hydroxide (KOH) aqueous solution, which are weakly toxic compounds, and that it can be usefully utilized for various electrochemical products because electroless plating is possible on various dielectric substrates and the size of platinum particles and thickness of the thin film can be adjusted according to a concentration and reaction conditions of the composition.

The present invention provides a composition for electroless platinum plating containing an alcohol, an aqueous solution of a platinum chloride compound, and an aqueous solution of a basic compound.

The alcohol is a C1-C4 alcohol, preferably methanol or ethanol. The alcohol is included in 30 to 90 parts by weight based on 100 parts by weight of the composition. Preferably, the alcohol is included in 40 to 90 parts by weight, 50 to 85 parts by weight, or 60 to 80 parts by weight based on 100 parts by weight of the composition, but is not limited thereto.

Here, the alcohol is a strong reducing agent and exists in a colloidal form in water, and supplies oxygen ions ($O^-$) on a substrate. The oxygen ions reduce platinum ions on the substrate to form a platinum thin film.

Further, the platinum chloride compound is selected from the group consisting of chloroplatinic acid ($H_2PtCl_6$), potassium hexachloroplatinate ($K_2PtCl_6$), and potassium tetrachloroplatinate ($K_2PtCl_4$), and may be included in the composition at a concentration of 1 to 10 mM. More specifically, the platinum chloride compound may be included in the composition at a concentration of 3 to 10 mM, 4 to 10 mM, or 6 to 10 mM.

According to an embodiment of the present invention, the composition containing chloroplatinic acid ($H_2PtCl_6$) as the platinum chloride compound at a concentration of 6 mM or more in a reaction composition formed an uniform and stable platinum thin film reproducibly on the substrate. Further, it was determined that the thickness of the platinum thin film to be plated could be controlled by controlling the concentration of platinum salt.

In addition, the basic compound is selected from the group consisting of potassium carbonate, sodium hydroxide, potassium hydroxide, and sodium bicarbonate, and may be included at a concentration of 0.05 to 5 M, 0.05 to 3 M, 0.05 to 1 M, or 0.1 to 0.5 M in the composition.

According to an embodiment of the present invention, it was determined that the composition including potassium hydroxide as the basic compound at a concentration of 0.1 M or 0.2 M or more in the reaction composition could stably and reproducibly form a platinum thin film on the substrate.

In addition, the present invention provides an electroless platinum plating method including dipping a substrate in the composition for electroless platinum plating and shaking it to form a platinum thin film.

Here, the shaking is performed at 100 to 200 rpm, preferably 150 to 200 rpm, but is not limited thereto.

Further, the shaking may be performed for 1 to 80 hours at a temperature of 50 to 100° C. More preferably, the shaking may be performed at a temperature of 50 to 80° C. or 50 to 70° C. for 10 to 80 hours, 20 to 80 hours, or 24 to 72 hours. In the case that the reaction temperature is low, a plating rate is slow, but a dense plated thin film can be obtained. In the case that the reaction temperature is increased, plating is accelerated and a fast plating rate can be obtained. The reaction temperature is preferably 50 to 70° C. because stability of the composition is reduced and its durability is shortened in the case that the reaction temperature is increased to a temperature higher than about 70° C.

Furthermore, in the case that the reaction time was 24 hours or more, it was determined that the deposited platinum thin film was most stable to external impact and formed uniformly. It was also determined as the reaction time increased, the number of platinum nanoparticles increased and the particles coalesced to form a network structure through bonding of large grains, thereby increasing the thickness of the thin film. Therefore, it would be possible to control the thickness of a platinum thin film to be plated by controlling the reaction time.

In the case the concentration conditions of the alcohol, the platinum chloride compound aqueous solution, and the basic compound aqueous solution contained in the composition for electroless platinum plating, and the reaction temperature and reaction time conditions of the plating process using the composition are out of the conditions as described above, the platinum plating according to the present invention may not be done properly. Thus, a platinum thin film may not be properly formed on the substrate or the yield of target products compared to the raw materials, time, and energy used may be significantly lowered, which may cause a problem of poor economic efficiency.

In addition, the substrate is not particularly limited as long as it is an object to which an electroless plating process can be applied. Although it may selected from the group consisting of glass, rubber, ceramics, paper, carbon paper, and natural materials, it is not limited thereto and plating may be made on a surface of non-conductive dielectric material.

In addition, the present invention provides a platinum-plated article and plating characteristics suitable for the purpose by performing an electroless platinum plating process using the composition for electroless platinum plating and controlling the plating rate and thin film characteristics.

Platinum (Pt), which is electroless-plated according to the present invention, is one of the important transition metals with high catalytic activity. Accordingly, the composition for electroless platinum plating and the electroless platinum plating method using it according to the present invention may be usefully used in semiconductor, energy, catalyst, medicine, and diagnostic applications.

In the present invention, first, a reaction composition was prepared by mixing an alcohol, an aqueous solution of a platinum chloride compound, and an aqueous solution of a basic compound. By dipping a substrate in the reaction composition and shaking it, a platinum (Pt) thin film was formed. The state of the platinum thin film adhering to a surface of the substrate was analyzed using an ultraviolet visible light spectrometer, a field emission scanning electron microscope, an X-ray diffraction analyzer, an X-ray photoelectron spectrometer, a field emission transmission electron microscope, an energy dispersive spectroscopy method, and a sheet resistance measuring instrument. As a result of the analysis, it was determined that the platinum thin film coated on the surface was formed by gathering nano-sized platinum particles, and the size of the platinum particles and growth of thin film thickness depended on the reaction time and the concentration of platinum salt.

Hereinafter, the present invention will be described in detail by way of exemplary embodiments. Those skilled in the art will recognize that the description is to be regarded as illustrative rather than restrictive on the present invention and the scope of the invention as claimed is not limited to the embodiments.

<Reference Example> Materials for Experiment

High purity chloroplatinic acid hexahydrate ($H_2PtCl_6 \cdot 6H_2O$) manufactured by Aldrich complying with the specifications presented by the Committee on Analytical Reagents of the American Chemical Society, and 99.5% purity ethyl alcohol were prepared. Potassium hydroxide (KOH) having a purity of 85.0% was purchased from Daejung Chemicals & Metals Co., LTD. Glass slides of 30 mm×10 mm×1 mm were purchased from Marienfield. Highly pure water having a resistivity of 18.2 M2 cm passed through a microfiltration paper was used.

<Example 1> Preparation of Electroless-Plated Platinum (Pt) Thin Film

The glass slide of 30 mm×10 mm×1 mm was used as a substrate, dipped in Piranha solution for 30 minutes, and dipped in aqua regia for 30 minutes. Then, it was washed repeatedly until acidity disappeared and stored. It was used after ultrasonic treatment for 5 minutes.

A reaction composition was prepared by mixing 4 mL of ethanol, 0.5 mL of a 79 mM aqueous chloroplatinic acid hexahydrate ($H_2PtCl_6$) aqueous solution, and 0.5 ml of a 2 M aqueous potassium hydroxide (KOH) solution. The washed substrate was dipped in the reaction composition, and the composition was sufficiently shook at 180 rpm at 60±5° C. for various periods of time (1, 2, 3, 6, 9, 12, 15, 18, 21, 24, 48, and 72 hours) for reaction to deposit platinum on the substrate.

At this time, the $H_2PtCl_6$ aqueous solution in the reaction composition was added at various concentrations of 16, 24, 32, 40, 47, 55, 63, and 79 mM, so that the final concentration of the platinum chloride salt in the reaction composition was adjusted to be 1.6, 2.4, 3.2, 4.0, 4.7, 5.5, 6.3, and 7.9 mM, respectively. After that, it was reacted with the substrate in the manner described above to deposit platinum. In addition, the aqueous KOH solution was added at various concentrations of 1, 2, 3, 4, 5, 6, 7, 8, 9, and 10 M, so that the final concentration of potassium hydroxide in the reaction composition was adjusted to be 0.1, 0.2, 0.3, 0.4, 0.5, 0.6, 0.7, 0.8, 0.9, and 1.0 M, respectively. After that, it was reacted with the substrate in the manner described above to deposit platinum. The substrate on which platinum (Pt) was deposited was washed with distilled water and dried in air.

<Example 2> Physical Property Analysis Method of Electroless-Plated Platinum (Pt) Thin Film Ultraviolet-visible spectra (hereinafter "UV-vis") was analyzed using a spectrum analyzer (Avantes 3648), and field-emission transmission electron microscopy (hereinafter "FE-TEM") was analyzed using a field emission transmission electron microscope (JEM-F200) in which the microscope was operated at 200 kV. Scanning electron microscope (hereinafter, "SEM") images were obtained using a Ultra Plus field emission scanning electron microscope manufactured by Carl-Zeiss.

In addition, energy dispersive X-ray (hereinafter "EDX") was analyzed using a SUPRA 55VP field emission transmission electron microscope (JEM-F200 (HRP)), in which the microscope was operated at 200 kV. X-ray diffraction (hereinafter "XRD") was analyzed using an X-ray diffractometer (Rigaku Model MiniFlex powder diffractometer), where Cu $K_\alpha$ radiation was used. X-ray photoelectron spectroscopy (hereinafter "XPS") was analyzed using a K-alpha+ model of ThermoFisher Scientific, and in this case, Al Kα X-rays were used as a light source.

In addition, Sheet Resistance Meter was analyzed using Dasol ENG's FPP-40K model, and a pen-type four-point probe was used as a probe.

<Experimental Example 1> Component Analysis of Electroless-Plated Pt Thin Film

FIG. 1(*a*) shows an XRD pattern of a platinum thin film (72-hour reaction) deposited on the glass substrate, and the XRD peaks located at 40.7°, 47.1°, 68.4°, 81.8°, and 86.2° corresponded to (111), (200), (220), (311), and (222) lattice planes, respectively (JCPDS 04-0802).

In addition, FIG. 1(*b*) shows an XPS analysis result (72-hour reaction) of a platinum thin film deposited on the glass substrate, and the XPS peaks (envelopes) identified at 70.1 eV and 74.3 eV corresponded to $4f_{7/2}$ and $4f_{5/2}$ peaks of Pt, respectively.

Therefore, it was determined that the platinum (Pt) component can be stably deposited on the substrate only by dipping and reacting the substrate in the reaction composition according to the present invention.

<Experimental Example 2> Analysis of Electroless-Plated Pt Thin Film According to Reaction Composition Dipping Time FIG. 2(*a*) to (*f*) are SEM images of platinum thin films deposited on glass substrates obtained by reaction for various reaction times, i.e. 24 hours (a, b), 48 hours (c, d), and 72 hours (e, f). It was determined that the platinum thin films deposited on the substrate surfaces were formed by nano-sized particles. It was also determined that, as the reaction time increased, the number of platinum nanoparticles increased and the particles coalesced to form a network structure through bonding of large grains, increasing the thickness of the thin films.

FIG. 2(*g*) shows the platinum thin films deposited on the glass substrates under the various time conditions, i.e. for 24 hours, 48 hours, and 72 hours, and it was determined that the platinum thin film deposited by reacting for 24 hours was most stable to external impact and uniformly formed.

In addition, FIG. 2(*h*) shows the platinum thin films deposited on the glass substrates under the various time conditions, i.e. for 1, 2, 3, 6, 9, 12, 15, 18, 21, and 24 hours, and it was determined that the platinum thin film deposited by reacting for 24 hours was most uniformly formed and had high reproducibility.

FIG. 3 shows FE-TEM images of the platinum thin film deposited on the glass substrate by reacting for 24 hours, and it was determined that platinum having an average particle diameter of about 4±1 nm was uniformly deposited on the substrate (Pt film) and plated.

<Experimental Example 3> Analysis of Electroless-Plated Pt Thin Film According to Concentration of Platinum Chloride Salt FIG. 4 shows platinum thin films deposited on the glass substrates by reacting for 24 hours with platinum chloride salts of various concentrations, i.e. the final concentrations of 1.5 mM, 2.0 mM, 2.5 mM, 3.0 mM, 4.0 mM, 5.0 mM, 6.0 mM, and 7.0 mM in the reaction composition and 0.1 M potassium hydroxide. As a result, it was determined that the thickness of the plated platinum thin film increased as the concentration of the platinum chloride salt increased.

FIG. 5(*a*) shows results of UV-vis absorption analysis of platinum thin films obtained by reacting the glass substrates with platinum chloride salts of various concentrations, i.e. the final concentrations of 1.6 mM, 3.2 mM, 4.7 mM, 6.3 mM, and 7.9 mM in the reaction composition and 0.1 M potassium hydroxide for 24 hours. According to the concentrations of the platinum chloride salt, the absorbance was measured a total of four times at a wavelength of 400 nm for the platinum thin films plated on the glass substrates and the results were compared (FIG. 5(*b*)). As a result, it was determined that the absorbance of the platinum thin film increased as the concentration of the platinum salt increased. This indicates that the amount of transmitted light decreases as the concentration of the platinum salt increases, which means that the thin film is thickly deposited. In addition, it was determined that the reproducibility was high at the concentration of 7.9 mM.

FIG. 6 shows results of measuring the sheet resistance of platinum thin films deposited on the glass substrates for 24 hours with platinum chloride salts of various concentrations, i.e., the final concentrations of 2.4 mM, 3.2 mM, 4.0 mM, 4.7 mM, 5.5 mM, 6.3 mM, and 7.9 mM in the reaction composition and 0.1 M potassium hydroxide. These are results of repeatedly measuring the sheet resistance after removing the platinum thin film of each concentration using Scotch tape. Consequently, it was determined that the platinum thin films prepared with the final concentrations of 6.3 mM and 7.9 mM exhibited low and stable sheet resistance in the repeated Scotch tape tests.

<Experimental Example 4> Analysis of Electroless-Plated Pt Thin Film According to Concentration of Potassium Hydroxide FIG. 7(*a*) shows platinum thin films obtained by reacting glass substrates with potassium hydroxide of various concentrations, i.e. the final concentrations of 0.1 M, 0.2 M, 0.3 M, 0.4 M, 0.5 M, 0.6 M, 0.7 M, 0.8 M, 0.9 M, and 1.0 M in the reaction composition and 7.9 mM platinum chloride salt for 24 hours. It was determined that the platinum thin film deposited by reacting with potassium hydroxide of the concentration of 0.1 M or 0.2 M was most uniformly formed and had high reproducibility.

FIG. 7(*b*) shows sheet resistance measurement results using platinum thin films obtained by reacting the glass substrates with 0.1 M and 0.2 M concentrations of potassium hydroxide and 7.9 mM platinum chloride salt for 24 hours, which are results of repeatedly measuring the sheet resistance after removing the platinum thin film of each concentration using Scotch tape. The platinum thin films prepared with potassium hydroxide with the final concentrations of 0.3 M, 0.4 M, 0.5 M, 0.6 M, 0.7 M, 0.8 M, 0.9 M, and 1.0 M were immediately peeled off by the Scotch tape tests, exhibiting low stability. This is why only the sheet resistance graphs of the platinum thin films prepared with the concentrations of 0.1 M and 0.2 M were shown. A total of three repeated tests showed that the stability and reproducibility of the platinum thin film formed at 0.2 M was higher than those at 0.1 M.

<Experimental Example 5> Analysis of Electroless-Plated Pt Thin Film According to Ratio of Alcohol FIG. 8 shows platinum thin films obtained by reacting the glass substrates with various ratios of the alcohol, i.e. 10, 20, 30, 40, 50, 60, 70, 80, and 90 parts by weight of ethanol based on 100 parts by weight of the reaction composition, sodium hydroxide or potassium hydroxide, and the platinum chloride salt for 18 hours. The final concentration of the platinum chloride salt in the composition was adjusted to 3 mM, and the final concentration of sodium hydroxide or potassium hydroxide was adjusted to 0.2 M. In the case of using sodium hydroxide, when 30 to 90 parts by weight of the alcohol was used, the most stable thin film was obtained. In the case of using potassium hydroxide, when 50 to 80 parts by weight of the alcohol was used, the most uniformly formed thin film was obtained.

<Experimental Example 6> Analysis of Pt Thin Film Electroless-Plated on Dielectric Surface As the optimal conditions derived according to the present invention, 4 mL of ethanol, 0.5 mL of 79 mM chloroplatinic acid hexahydrate ($H_2PtCl_6$) aqueous solution, and 0.5 mL of 2M potassium hydroxide (KOH) aqueous solution were mixed to prepare a reaction composition adjusted to have a final concentration of platinum chloride salt of 7.9 mM and a final concentration of potassium hydroxide of 0.2 M in the composition. Several washed substrates were dipped in the reaction composition and reacted with sufficient shaking at 180 rpm at 60±5° C. for 24 hours to deposit platinum on the substrates. FIG. 9 shows platinum thin films deposited on the substrates, (a) ceramic, (b) carbon paper, (c) a leaf, (d) wooden chopsticks, (e) a rubber hose, and (f) a rubber septum.

Therefore, according to the method for producing platinum thin films using the electroless plating as described above, it was determined that stable platinum thin films could be formed simply on surfaces of various dielectric materials.

What is claimed is:

1. An electroless platinum plating method, comprising:

preparing a composition for electroless platinum plating, the composition consisting of:

an alcohol;

an aqueous solution of chloroplatinic acid ($H_2PtCl_6$) included in the composition at a concentration of 6.3 to 7.9 mM; and an aqueous solution of potassium hydroxide included in the composition at a concentration of 0.2 M;

dipping a substrate in the composition; and shaking the composition at 100 to 200 rpm to form a platinum thin film on the substrate, wherein the substrate is selected from the group consisting of glass, rubber, ceramic, paper, carbon paper, wood, and leaves.

2. The electroless platinum plating method according to claim 1, wherein the shaking is performed at a temperature of 50 to 100° C. for 1 to 80 hours.

3. The electroless platinum plating method according to claim 1, wherein the alcohol is a C1-C4 alcohol.

4. The electroless platinum plating method according to claim 1, wherein the alcohol is included in an amount of 30 to 90 parts by weight based on 100 parts by weight of the composition.

* * * * *